US010660436B2

(12) United States Patent
Chen et al.

(10) Patent No.: US 10,660,436 B2
(45) Date of Patent: May 26, 2020

(54) SLIDE RAIL ASSEMBLY

(71) Applicants: King Slide Works Co., Ltd., Kaohsiung (TW); King Slide Technology Co., Ltd., Kaohsiung (TW)

(72) Inventors: Ken-Ching Chen, Kaohsiung (TW); Shih-Lung Huang, Kaohsiung (TW); Chien-Hung Kuo, Kaohsiung (TW); Chun-Chiang Wang, Kaohsiung (TW)

(73) Assignees: KING SLIDE WORKS CO., LTD.; KING SLIDE TECHNOLOGY CO., LTD., Kaohsiung (TW)

( * ) Notice: Subject to any disclaimer, the term of this patent is extended or adjusted under 35 U.S.C. 154(b) by 0 days.

(21) Appl. No.: 16/124,272

(22) Filed: Sep. 7, 2018

(65) Prior Publication Data

US 2019/0330902 A1 Oct. 31, 2019

(30) Foreign Application Priority Data

Apr. 30, 2018 (TW) ..... 107114963 A

(51) Int. Cl.
*A47B 88/467* (2017.01)

(52) U.S. Cl.
CPC ..... *A47B 88/467* (2017.01)

(58) Field of Classification Search
CPC ..... A47B 88/467; A47B 2210/0094; A47B 88/40; A47B 88/463; A47B 88/49; A47B 2210/0018; A47B 2210/0059; A47B 2210/007; A47B 2210/0016; A47B 88/46; A47B 88/47; A47B 2088/4675; A47B 2210/0091; A47B 88/453; A47B 88/443; A47B 88/477; A47B 88/57
USPC ..... 312/333, 334.44, 334.7, 319.1
See application file for complete search history.

(56) References Cited

U.S. PATENT DOCUMENTS

| | | | | |
|---|---|---|---|---|
| 6,945,619 | B1 * | 9/2005 | Chen | A47B 88/487 312/334.47 |
| 7,677,679 | B2 * | 3/2010 | Hsiung | A47B 88/49 312/333 |
| 7,878,606 | B2 | 2/2011 | Chen et al. | |
| 8,147,010 | B2 | 4/2012 | Chen et al. | |
| 8,277,022 | B2 | 10/2012 | Perez et al. | |

(Continued)

FOREIGN PATENT DOCUMENTS

JP H07303537 A 11/1995

*Primary Examiner* — Hiwot E Tefera
(74) *Attorney, Agent, or Firm* — Alan D. Kamrath; Karin L. Williams; Mayer & Williams PC

(57) ABSTRACT

A slide rail assembly includes a first rail, a second rail, a base, an elastic member and a working member. The first rail is arranged with a positioning part. The second rail is movable relative to the first rail from a retracted position along a first direction and arranged with an engaging feature. The base is movably mounted to the first rail. The working member is rotatable relative to the base and arranged with an actuating structure. The actuating structure includes first and second parts. The second part is configured to be engaged with the positioning part, so as to allow the elastic member to accumulate an elastic force along a second direction. The first part is configured to be engaged with the engaging feature. The first part is arranged with a holding feature for preventing the engaging feature from being detached from the working member along a predetermined direction.

18 Claims, 12 Drawing Sheets

(56) References Cited

U.S. PATENT DOCUMENTS

| | | | | |
|---|---|---|---|---|
| 8,282,176 | B1 * | 10/2012 | Chen | A47B 88/493 312/333 |
| 8,671,520 | B2 * | 3/2014 | Tanno | E05F 1/16 16/49 |
| 8,801,120 | B2 * | 8/2014 | Chen | A47B 88/47 312/333 |
| 9,759,002 | B2 * | 9/2017 | Muller | E05F 3/10 |
| 2004/0227438 | A1 * | 11/2004 | Tseng | A47B 88/467 312/333 |
| 2007/0001562 | A1 | 1/2007 | Park | |
| 2008/0197759 | A1 * | 8/2008 | Chen | A47B 88/467 312/334.1 |
| 2009/0001864 | A1 * | 1/2009 | Huang | A47B 88/49 312/333 |
| 2009/0115300 | A1 * | 5/2009 | Chen | H05K 7/1421 312/334.1 |
| 2009/0189499 | A1 * | 7/2009 | Yang | A47B 88/467 312/334.44 |
| 2011/0043087 | A1 * | 2/2011 | Shih | A47B 88/467 312/334.1 |
| 2011/0175508 | A1 * | 7/2011 | Rechberg | E05F 3/108 312/334.8 |
| 2012/0144622 | A1 | 6/2012 | Juan et al. | |
| 2013/0028544 | A1 * | 1/2013 | Lowe | A47B 88/467 384/21 |
| 2014/0079347 | A1 * | 3/2014 | Huang | A47B 88/467 384/21 |
| 2015/0091427 | A1 * | 4/2015 | Haemmerle | A47B 88/40 312/333 |
| 2015/0366345 | A1 * | 12/2015 | Chen | A47B 88/467 312/319.1 |
| 2018/0132615 | A1 * | 5/2018 | Kim | A47B 88/477 |

* cited by examiner

SLIDE RAIL ASSEMBLY

BACKGROUND OF THE INVENTION

1. Field of the Invention

The present invention relates to a slide rail assembly, and more particularly, to a slide rail assembly capable of improving reliability between a slide rail and a returning mechanism.

2. Description of the Prior Art

US patent publication number US 2007/0001562 A1 discloses a self-closing device for a slide. The slide (10) comprises a fixed rail (800), an intermediate movable rail (900), an inner movable rail (700) and a self-closing apparatus (20). Wherein, the self-closing apparatus (20) comprises a fixed member (100), a movable member (200), a pair of springs (500) and a moving pin (400) engaged with a moving pin guide (300) coupled to the inside of the inner movable rail (700).

As shown in FIG. 10*a*, FIG. 10*b* and FIG. 7*b* of the aforementioned application, the movable member (200) can be moved relative to the fixed member (100) from an initial position to a predetermined position, and the moving pin (400) can be moved from a rectilinear guide portion (124) to a curved guide portion (125) of the fixed member (100) to engage the fixed member (100) with the curved guide portion (125), such that the springs (500) can accumulate a tensile force for allowing the inner movable rail (700) to have self-closing function relative to the fixed rail (800).

However, the moving pin guide (300) and the moving pin (400) do not have any detachment prevention mechanism. Therefore, when the inner movable rail (700) or the moving pin guide (300) is transversely or laterally moved due to tolerance or an external force, the moving pin guide (300) may not be smoothly engaged with the moving pin (400). In other words, the self-closing function of the slide may fail.

In addition, since the moving pin (400) penetrates through the movable member (200), the slide may be shaken or unstable when the moving pin (400) is moved from the rectilinear guide portion (124) to the curved guide portion (125) of the fixed member (100).

Furthermore, the rectilinear guide portion (124) and the curved guide portion (125) are communicated with each other and arranged on the fixed member (100). Therefore, when the inner movable rail (700) is retracted from an extension position along a retraction direction, and the inner movable rail (700) drives the moving pin (400) to move back to the rectilinear guide portion (124) from the curved guide portion (125) through engaging the moving pin guide (300) with the moving pin (400), a returning distance of the inner movable rail (700) relative to the fixed rail (800) is difficult to adjust since a length of the rectilinear guide portion (124) cannot be changed on the fixed member (100).

Therefore, it is important to develop a different slide rail with returning function.

SUMMARY OF THE INVENTION

The present invention relates to a slide rail assembly capable of improving reliability between a slide rail and a returning mechanism.

According to an embodiment of the present invention, a slide rail assembly comprises a first rail, a second rail, a base, an elastic member and a working member. The first rail is arranged with a positioning part and a guiding part. The second rail is longitudinally movable relative to the first rail. The second rail is arranged with an engaging feature. The base is configured to be located between a first position and a second position relative to the first rail. The elastic member is configured to provide an elastic force to the base. The working member is rotatable relative to the base. The working member is arranged with an actuating structure. The actuating structure comprises a first part and a second part. Wherein, when the second rail is moved relative to the first rail from a retracted position along a first direction, the second rail is configured to drive the working member and the base to move away from the first position through the engaging feature being engaged with the first part of the actuating structure; and when the working member is deflected by the second part of the actuating structure through guiding of the guiding part, the second part of the actuating structure is configured to be engaged with the positioning part to hold the base at the second position, and the first part of the actuating structure is configured to be disengaged from the engaging feature of the second rail. Wherein, when the base is held at the second position, the elastic member is configured to accumulate an elastic force along a direction toward the first position in order to retract the second rail from a predetermined position to the retracted position along a second direction. Wherein, the first part of the actuating structure is arranged with a holding feature for preventing the engaging feature of the second rail from being detached from the working member along a transverse direction.

Preferably, the guiding part is adjacent to the positioning part, and the guiding part has one of an inclined surface and a curved surface.

Preferably, the slide rail assembly further comprises a fixing member arranged on the first rail. Wherein, the base is movably mounted to the first rail, and the elastic member is connected to the fixing member and the base.

Preferably, the first rail has a front part and a rear part. The fixing member is located between the front part and the rear part.

Preferably, the fixing member is adjacent to the rear part of the first rail.

Preferably, a predetermined distance is defined between the fixing member and the positioning part.

Preferably, the working member is pivoted to the base through a shaft, and the first part and the second part of the actuating structure are respectively located at two sides of the working member.

Preferably, the working member is formed with a space. The first part of the actuating structure is movable relative to the working member through the space.

Preferably, a damping medium is filled in the space.

Preferably, a radial dimension of the holding feature is greater than a radial dimension of the first part.

Preferably, the first part of the actuating structure is fixed relative to the working member.

According to another embodiment of the present invention, a slide rail assembly comprises a first rail, a second rail, a base, an elastic member and a working member. The first rail is arranged with a positioning part. The second rail is configured to be located between a retracted position and a predetermined position relative to the first rail. The second rail is arranged with an engaging feature. The base is configured to be located between a first position and a second position relative to the first rail. The working member is pivoted to the base. The working member is arranged with an actuating structure. Wherein, when the base is located at the second position with the working member being engaged with the positioning part, the elastic member is configured to accumulate an elastic force along a direction toward the first position. Wherein, the second rail is configured to be engaged with the actuating structure on the working member through the engaging feature, in order to disengage the working member from the positioning part, such that the base is moved toward the first position in response to the elastic force of the elastic member, so as to retract the second rail from the predetermined position to the retracted position. Wherein, the actuating structure comprises a holding feature configured to prevent the engaging feature of the second rail from being detached from the working member along a predetermined direction.

According to another embodiment of the present invention, a slide rail assembly comprises a first rail, a second rail, a base, an elastic member and a working member. The first rail is arranged with a positioning part. The second rail is movable relative to the first rail from a retracted position along a first direction. The second rail is arranged with an engaging feature. The base is movably mounted to the first rail. The elastic member is configured to provide an elastic force to the base. The working member is rotatable relative to the base. The working member is arranged with an actuating structure. The actuating structure comprises a first part and a second part. Wherein, the second part of the actuating structure is configured to be engaged with the positioning part of the first rail, in order to allow the elastic member to accumulate the elastic force for moving the second rail from a predetermined position to the retracted position along a second direction. Wherein, the first part of the actuating structure is configured to be engaged with the engaging feature of the second rail, and the first part of the actuating structure is arranged with a holding feature configured to prevent the engaging feature of the second rail from being detached from the working member along a predetermined direction.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
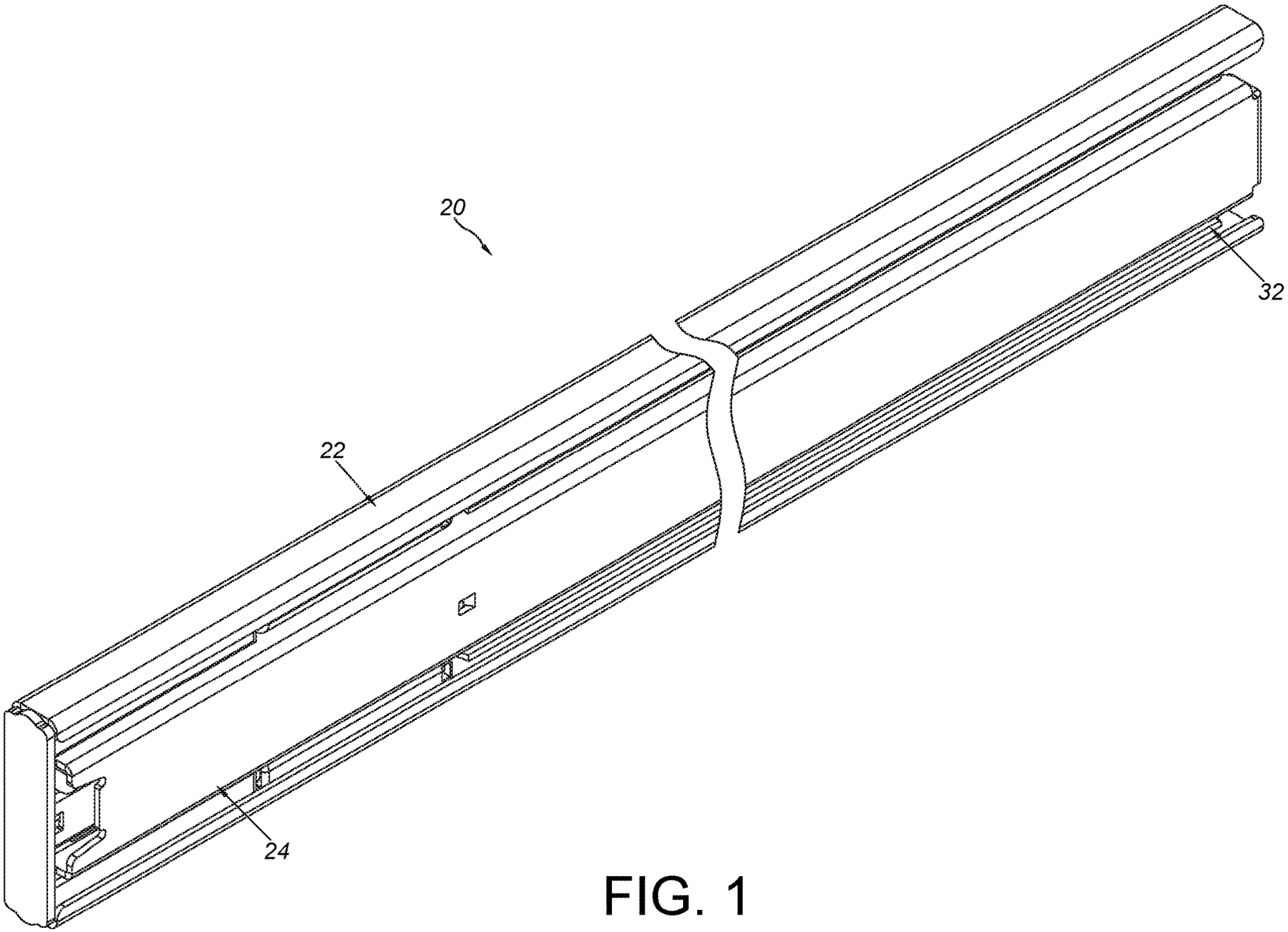
FIG. 1 is a diagram showing a slide rail assembly according to an embodiment of the present invention.

As shown in FIG. 1, a slide rail assembly 20 comprises a first rail 22 and a second rail 24 according to an embodiment of the present invention. Wherein, the second rail 24 is retracted relative to the first rail 22. Preferably, the slide rail assembly 20 further comprises a third rail 32 movably mounted between the first rail 22 and the second rail 24. The third rail 32 is configured to extend a longitudinal traveling distance of the second rail 24 relative to the first rail 22.

Figure 2:
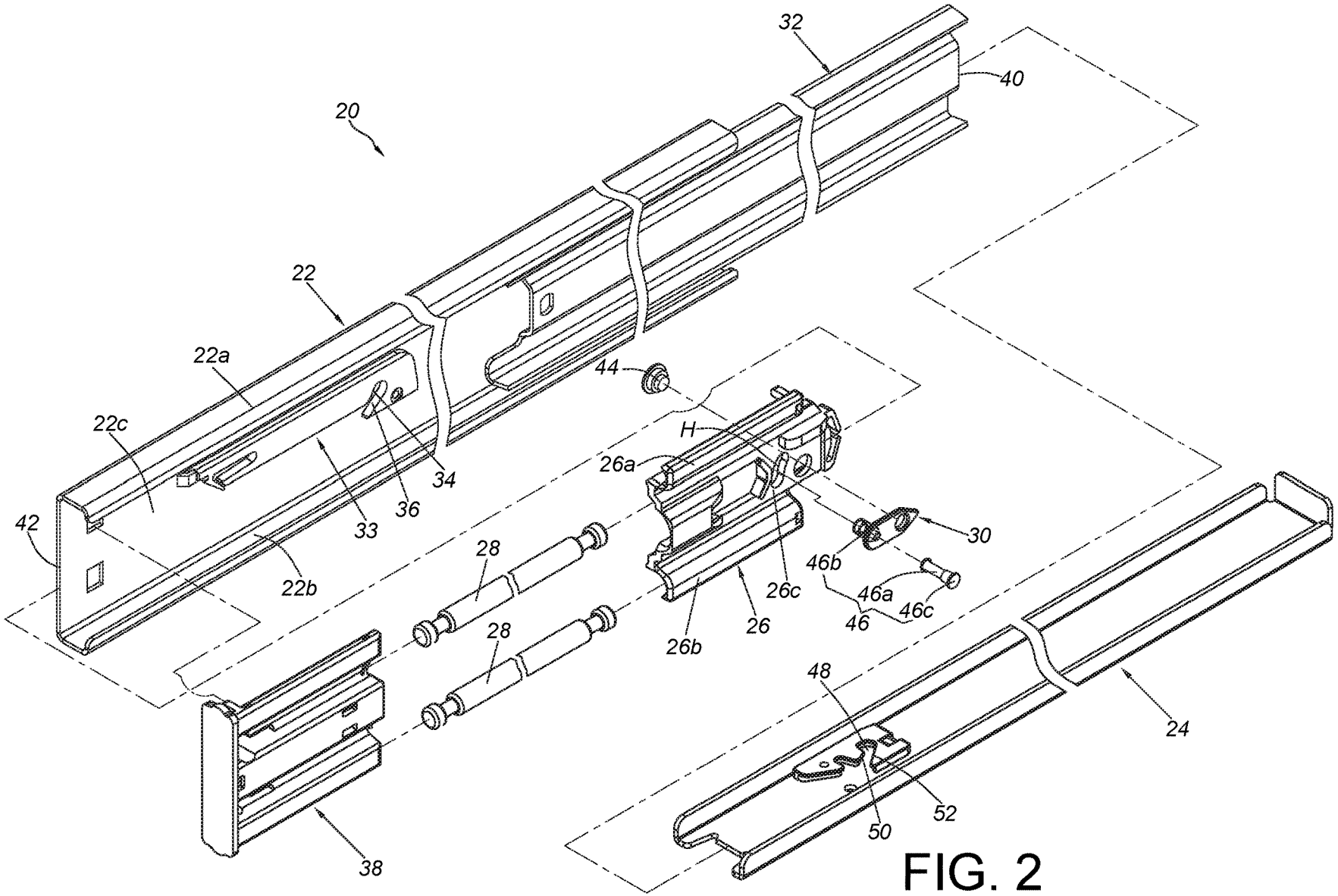
FIG. 2 is an exploded view of the slide rail assembly according to an embodiment of the present invention.
Figure 3:
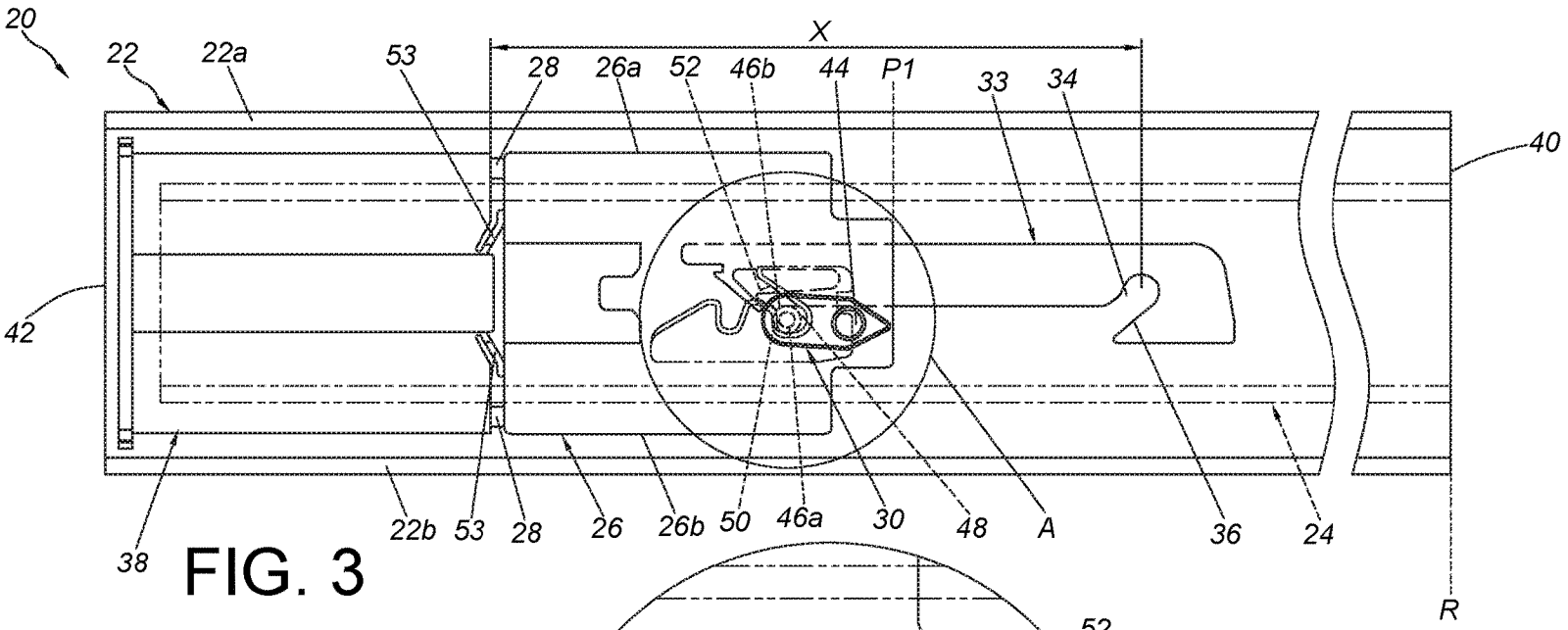
FIG. 3 is a diagram showing the slide rail assembly according to an embodiment of the present invention.

As shown in FIG. 2 and FIG. 3, the slide rail assembly 20 comprises a base 26, at least one elastic member 28 and a working member 30.

The first rail 22 has a first wall 22*a*, a second wall 22*b* and a longitudinal wall 22*c* connected between the first wall 22*a* and the second wall 22*b*. A passage is defined by the first wall 22*a*, the second wall 22*b* and the longitudinal wall 22*c* for accommodating the third rail 32. The first rail 22 is arranged with a positioning part 34 and a guiding part 36. The positioning part 34 and the guiding part 36 are integrated on the first rail 22. In the present embodiment, a positioning member 33 is arranged on the longitudinal wall 22*c* of the first rail 22, and the positioning member 33 comprises the positioning part 34 and the guiding part 36 adjacent to the positioning part 34. Wherein, the guiding part 36 has one of an inclined surface and a curved surface.

The base 26 is movably mounted to the first rail 22. For example, the base 26 is mounted into the passage of the first rail 22, but the present invention is not limited thereto. Preferably, the base 26 comprises a first side wall 26*a*, a second side wall 26*b* and a middle wall 26*c* connected between the first side wall 26*a* and the second side wall 26*b*. Wherein, the first side wall 26*a*, the second side wall 26*b* and the middle wall 26*c* are located at positions respectively corresponding to the first wall 22*a*, the second wall 22*b* and the longitudinal wall 22*c* of the first rail 22.

The elastic member 28 is configured to provide an elastic force to the base 26. In the present embodiment, the slide rail assembly 20 comprises two elastic members 28, but the present invention is not limited thereto. Preferably, the slide rail assembly 20 further comprises a fixing member 38 located between a front part 40 and a rear part 42 of the first rail 22. Preferably, the fixing member 38 is arranged on the first rail 22 and adjacent to the rear part 42 of the first rail 22. Wherein, the fixing member 38 can be integrally formed on the first rail 22; or the fixing member 38 can be connected to the first rail 22 by engaging, screwing or riveting. Preferably, the elastic member 28 is connected between the fixing member 38 and the base 26. Preferably, the fixing member 38 and the positioning part 34 (or the positioning member 33) are spaced from each other, and a predetermined distance X is defined between the fixing member 38 and the positioning part 34. The predetermined distance X is substantially treated as an automatic returning distance of the second rail 24 relative to the first rail 22.

The working member 30 is movably mounted to the base 26. For example, the working member 30 is pivoted to the middle wall 26*c* of the base 26 through a shaft 44. In other words, the working member 30 is rotatable relative to the base 26. The working member 30 is arranged with an actuating structure 46. Preferably, the actuating structure 46 comprises a first part 46*a* and a second part 46*b* respectively located at two sides of the working member 30. Preferably, the second part 46*b* of the actuating structure 46 passes through a hole, a groove or a notch of the base 26. In the present embodiment, the second part 46*b* of the actuating structure 46 passes a curved hole H of the base 26, but the present invention is not limited thereto.

The second rail 24 is longitudinally movable relative to the first rail 22. The second rail 24 is arranged with an engaging feature 48. The engaging feature 48 is formed with an engaging hole. The engaging feature 48 comprises a wall part 50 and a guiding section 52 adjacent to the engaging hole. The guiding section 52 has one of an inclined surface and a curved surface. Such configuration is well known to those skilled in the art. For simplification, no further illustration is provided.

Figure 4:
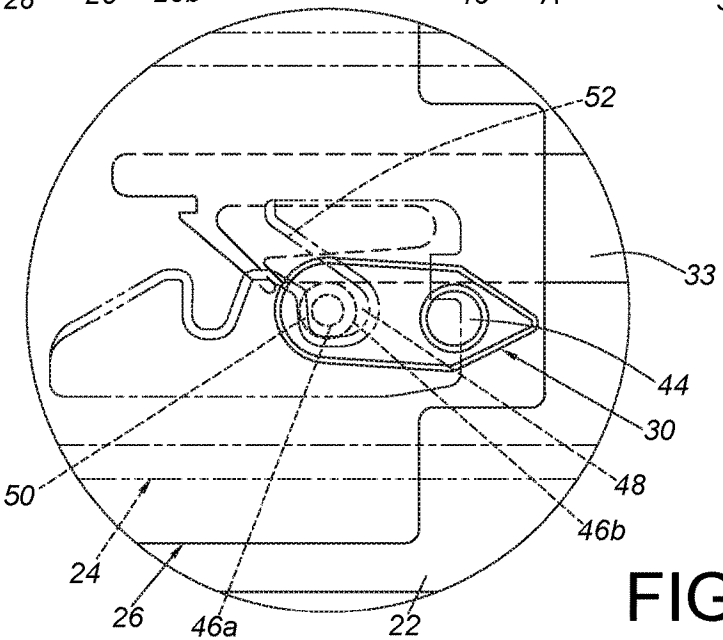
FIG. 4 is an enlarged view of an area A of FIG. 3.

As shown in FIG. 3 and FIG. 4, the second rail 24 is located at a retracted position R relative to the first rail 22, and the base 26 is located at a first position P1 relative to the first rail 22.

Figure 5:
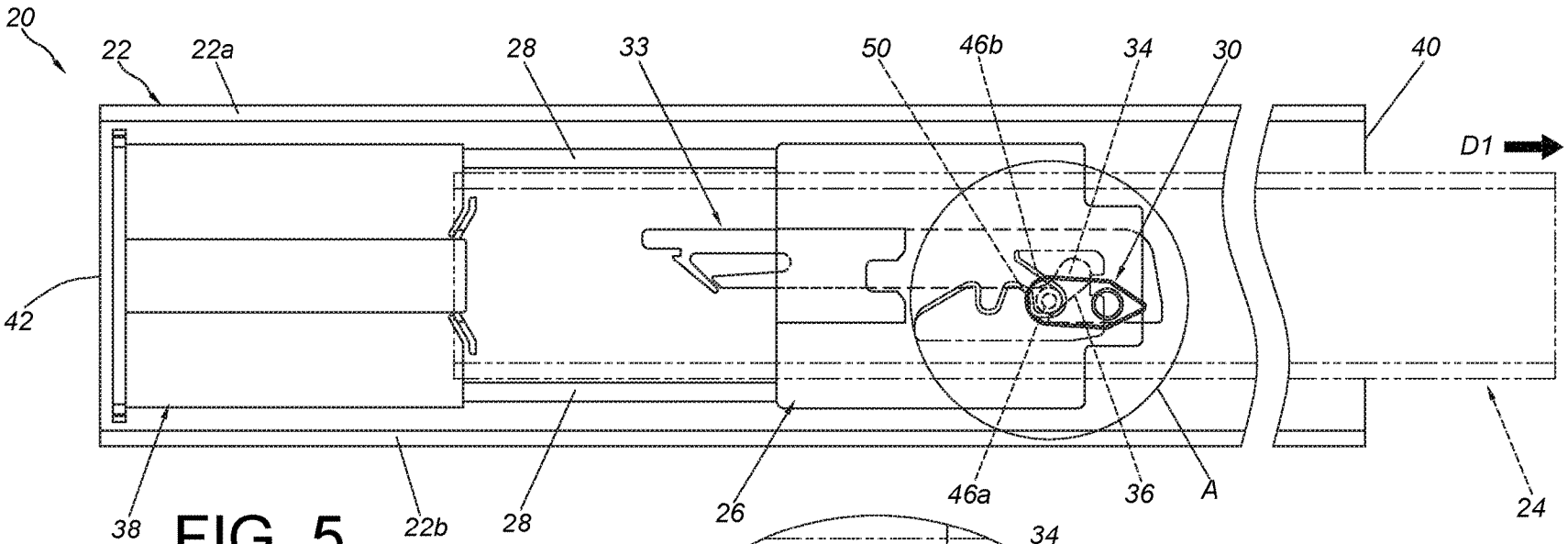
FIG. 5 is a diagram showing a second rail of the slide rail assembly being moved relative to a first rail along a first direction according to an embodiment of the present invention.
Figure 6:
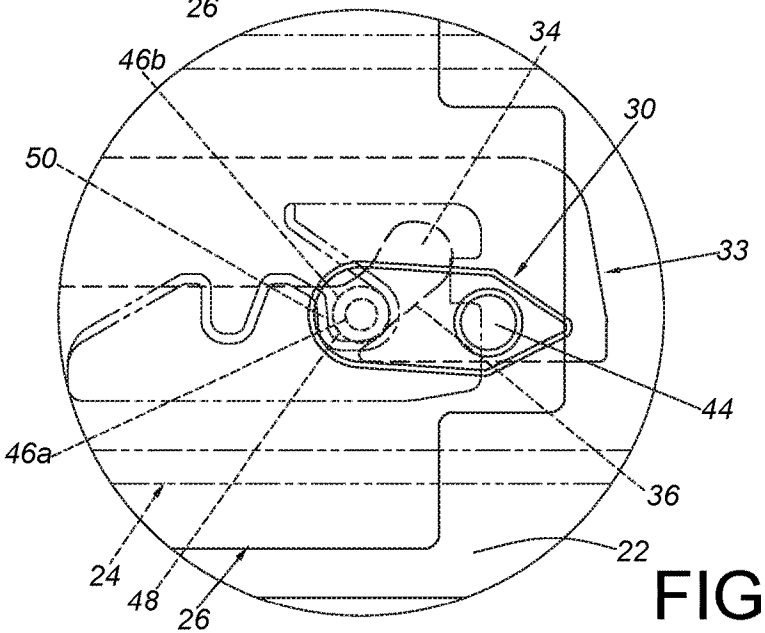
FIG. 6 is an enlarged view of an area A of FIG. 5.

As shown in FIG. 5 and FIG. 6, when the second rail 24 is moved relative to the first rail 22 from the retracted position R along a first direction D1, the second rail 24 is configured to drive the working member 30 and the base 26 to move away from the first position P1 through the engaging feature 48 being engaged with the first part 46*a* of the actuating structure 46. Wherein, when the second rail 24 is moved along the first direction D1 a predetermined traveling distance, the second part 46*b* of the actuating structure 46 contacts the guiding part 36 of the first rail 22. In addition, the elastic member 28 is stretched to gradually accumulate an elastic force along a second direction D2 (opposite to the first direction D1).

Figure 7:
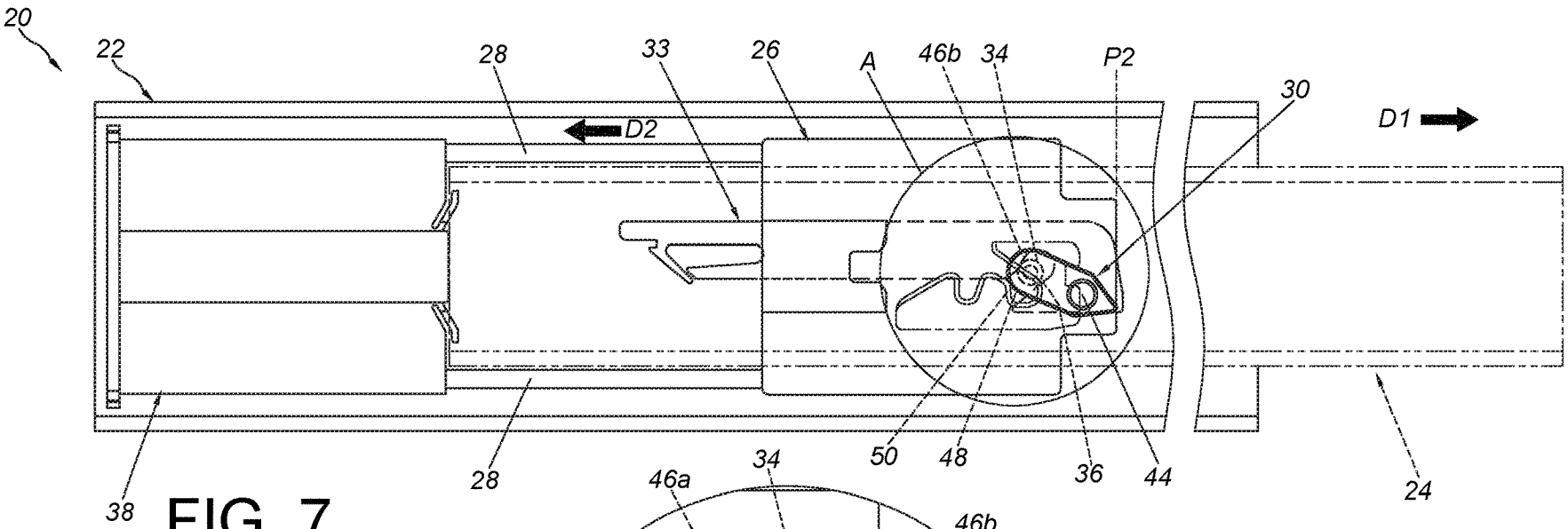
FIG. 7 is a diagram showing the second rail of the slide rail assembly being further moved relative to the first rail along the first direction according to an embodiment of the present invention.
Figure 8:
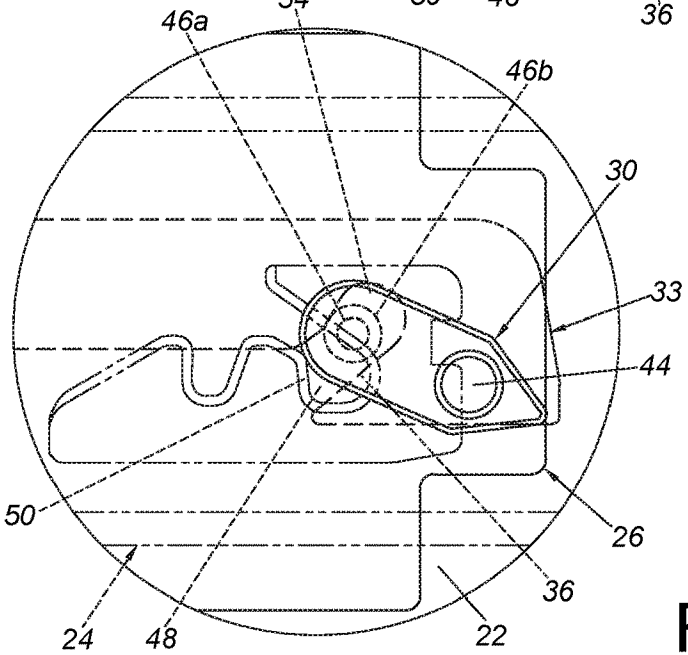
FIG. 8 is an enlarged view of an area A of FIG. 7.

As shown in FIG. 7 and FIG. 8, when the second rail 24 is further moved relative to the first rail 22 along the first direction D1, the working member 30 and the base 26 are driven by the second rail 24 to move to a second position P2. Wherein, the working member 30 is deflected through the second part 46*b* of the actuating structure 46 of the working member 30 being guided by the guiding part 36 of the first rail 22, and the second part 46*b* of the actuating structure 46 is engaged with the positioning part 34 of the first rail 22 so as to hold the base 26 at the second position P2 through the working member 30.

Figure 9:
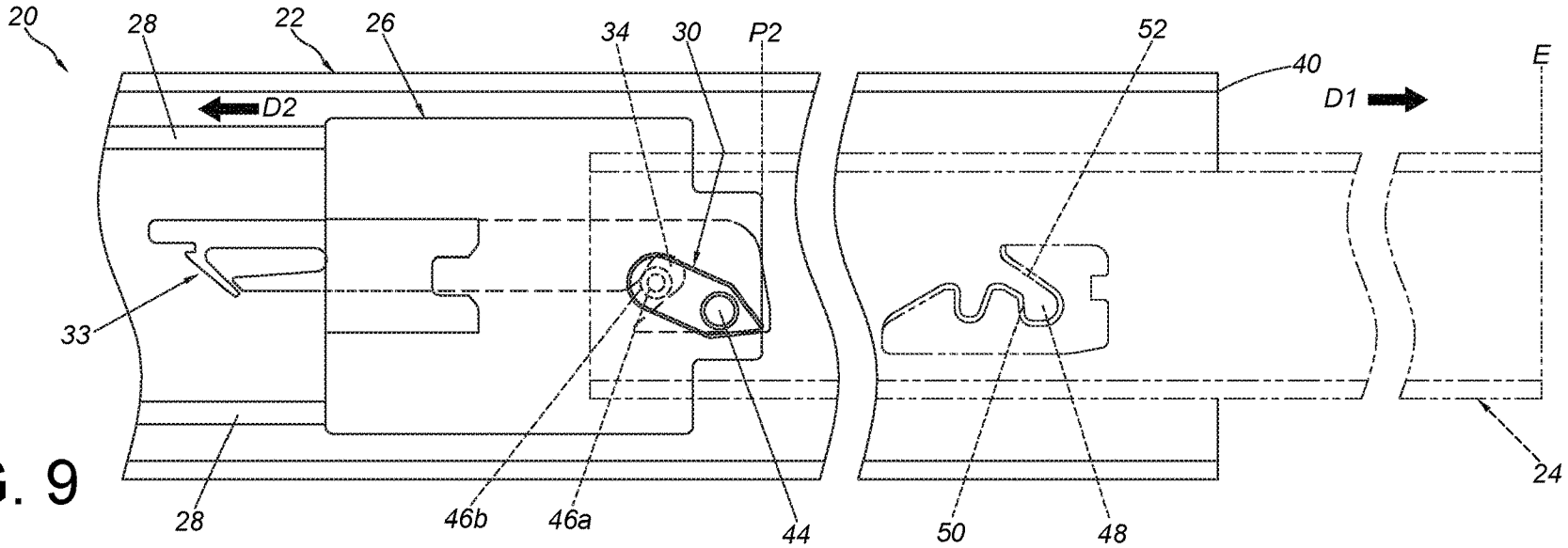
FIG. 9 is a diagram showing the second rail of the slide rail assembly being further moved relative to the first rail along the first direction according to an embodiment of the present invention.

As shown in FIG. 9, when the second part 46*b* of the actuating structure 46 of the working member 30 is engaged with the positioning part 34 of the first rail 22, and the base 26 is held at the second position P2 relative to the first rail 22, the first part 46*a* of the actuating structure 46 can be disengaged from the engaging feature 48 of the second rail 24 due to deflection of the working member 30. In such state, the second rail 24 can be further moved relative to the first rail 22 along the first direction D1 to an extension position E. Moreover, when the base 26 is held at the second position P2 relative to the first rail 22, the elastic member 28 is held in a state of accumulating the elastic force along the second direction D2 (opposite to the first direction D1). In other words, the elastic member 28 accumulates an elastic force along a direction toward the first position P1.

Figure 10:
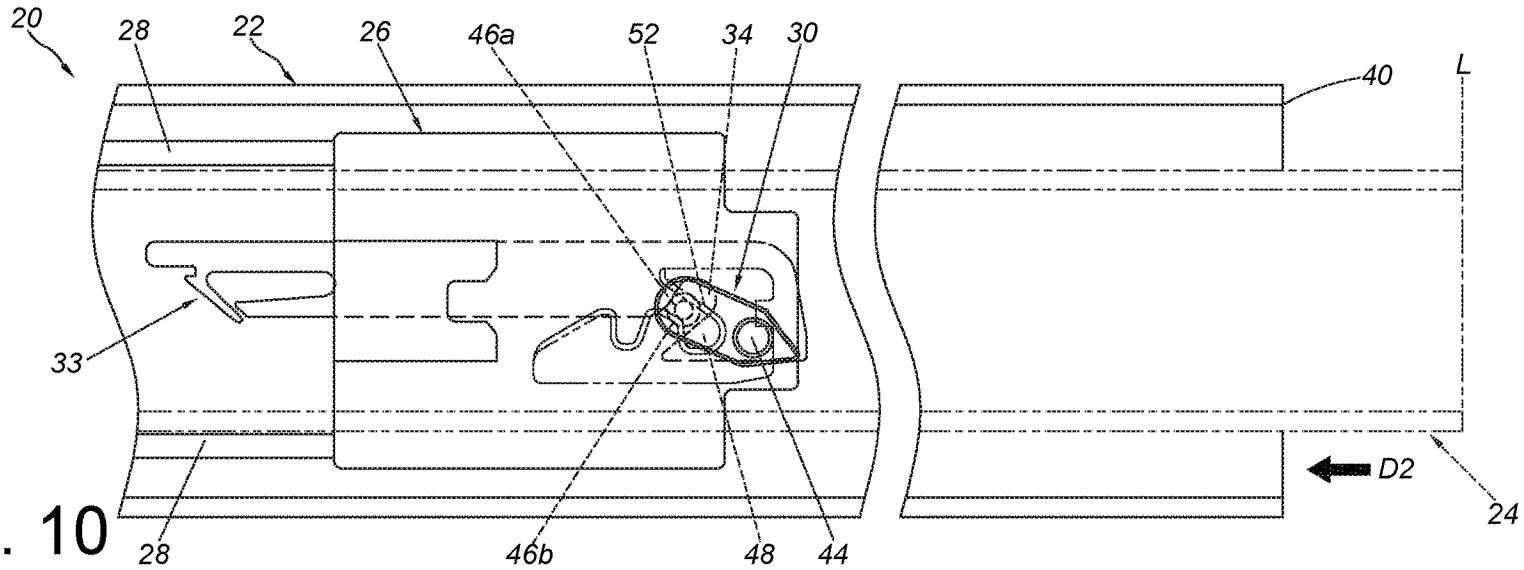
FIG. 10 is a diagram showing the second rail of the slide rail assembly being moved relative to the first rail along a second direction according to an embodiment of the present invention.

As shown in FIG. 10, the second rail 24 is located at a predetermined position L relative to the first rail 22. For example, when the second rail 24 is moved relative to the first rail 22 from the extension position E to the predetermined position L along the second direction D2, the elastic force accumulated by the elastic member 28 is released to retract the second rail 24 from the predetermined position L toward the retracted position R along the second direction D2. In other words, the second rail 24 can be automatically retracted relative to the first rail 22 in response to the elastic force of the elastic member 28.

Specifically, when the second rail 24 is moved form the extension position E to the predetermined position L along the second direction D2, the first part 46*a* of the actuating structure 46 is configured to engage with the engaging feature 48 again through guiding of the guiding section S2 (that is, the second rail 24 can be engaged with the first part 46*a* of the actuating structure 46 of the working member 30 again through the engaging feature 48), so as to deflect the working member 30 to be disengaged from the positioning part 34. As such, the second rail 24 can be retracted from the predetermined position L toward the retracted position R along the second direction D2 in response to the elastic force of the elastic member 28. In other words, the base 26 is moved toward the first position P1 in response to the elastic force of the elastic member 28 to retract the second rail 24 from the predetermined position L toward the retracted position R (please also refer to FIG. 5 and FIG. 3 sequentially for related configuration, no further illustration is provided for simplification). Moreover, as shown in FIG. 3, during a process of the second rail 24 returning to the retracted position R, the base 26 is configured to abut against a buffering mechanism 53 (such as an elastic arm, a flexible object or a buffering rod, but the present invention is not limited thereto) of the fixing member 38 at the first position P1, such that buffering and silencing effects can be provided while the second rail 24 is automatically retracted relative the first rail 22.

As shown in FIG. 11, FIG. 12, FIG. 13 and FIG. 14, the actuating structure 46 of the working member 30 further comprises a holding feature 46*c*. The holding feature 46*c* is connected to the first part 46*a* of the actuating structure 46 and configured to prevent the engaging feature 48 of the second rail 24 from being detached from the working member 30 along a predetermined direction K (such as a transverse direction or a lateral direction), in order to improve reliability of engagement between the engaging feature 48 of the second rail 24 and the first part 46*a* of the actuating structure 46.

Figure 11:
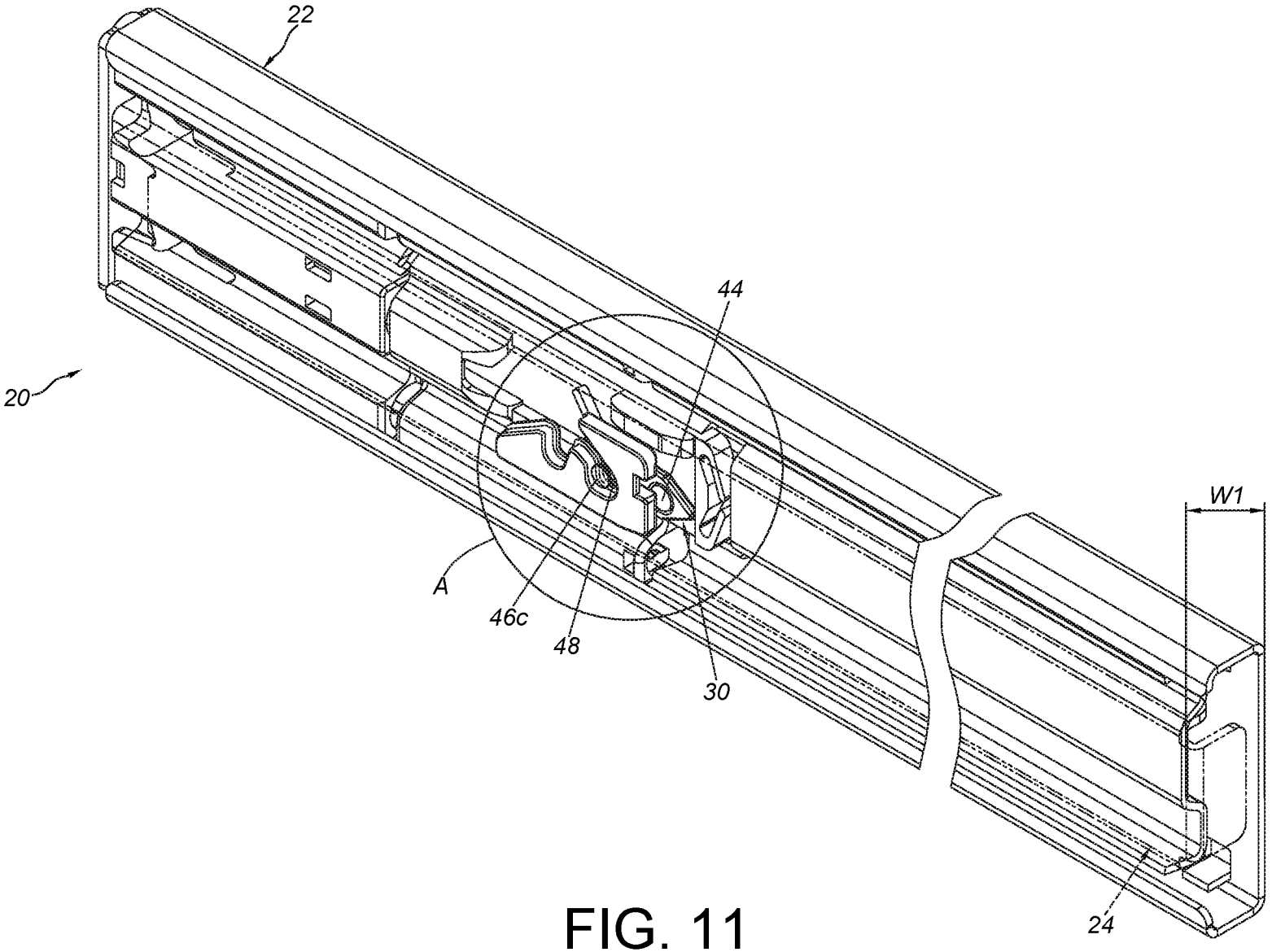
FIG. 11 is a diagram showing a width being defined between the second rail and the first rail of the slide rail assembly according to an embodiment of the present invention.
Figure 12:
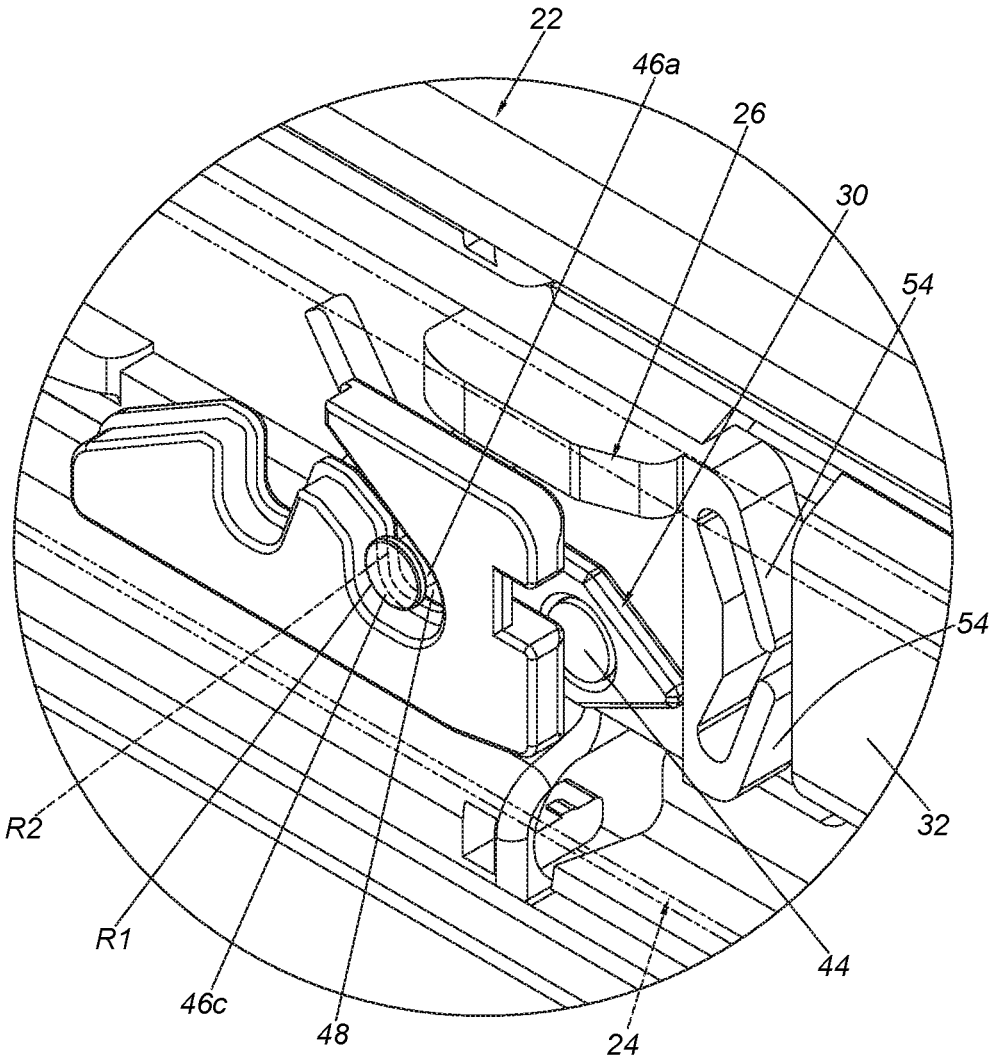
FIG. 12 is an enlarged view of an area A of FIG. 11.
Figure 13:
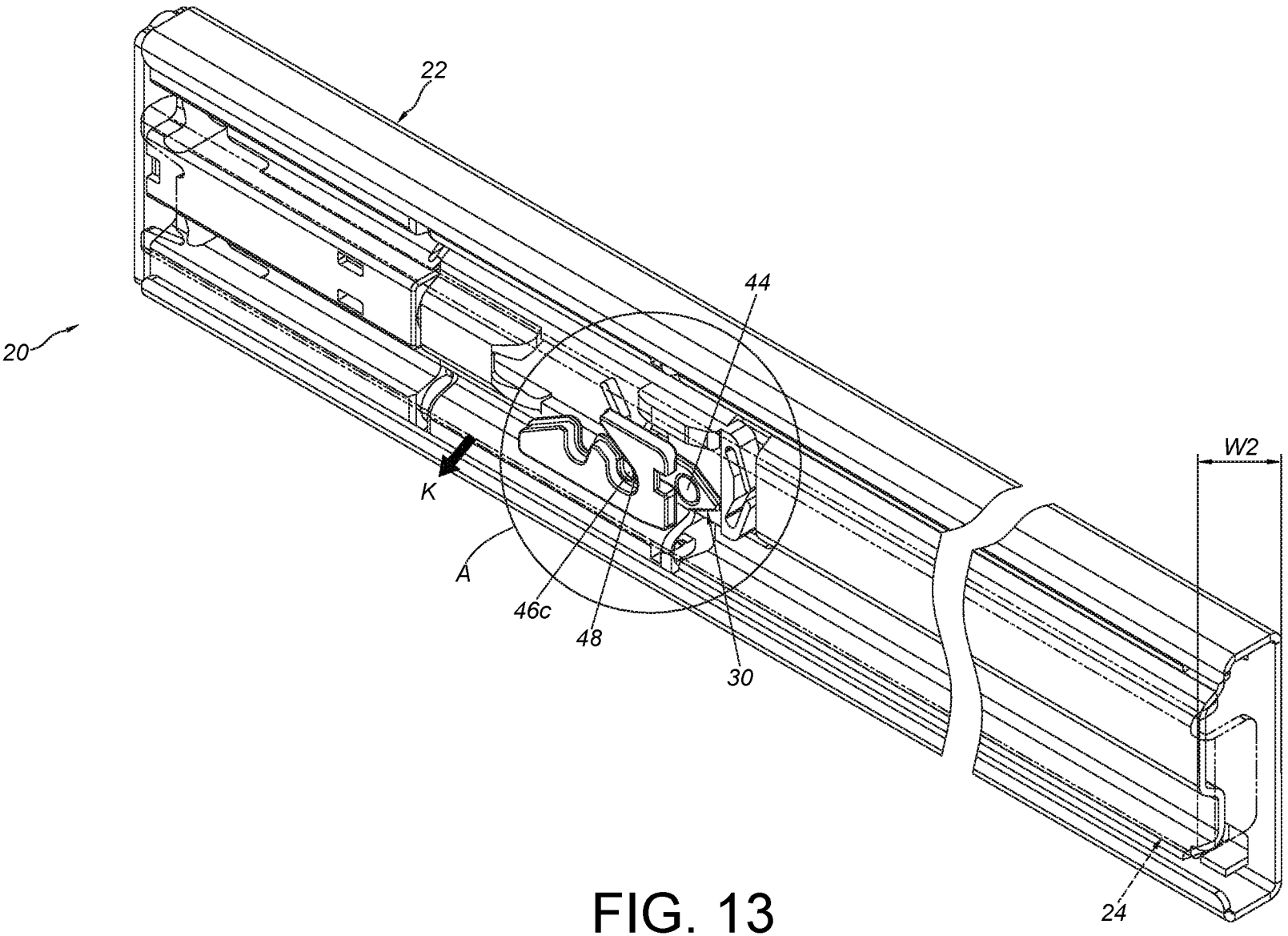
FIG. 13 is a diagram showing another width being defined between the second rail and the first rail of the slide rail assembly according to an embodiment of the present invention.
Figure 14:
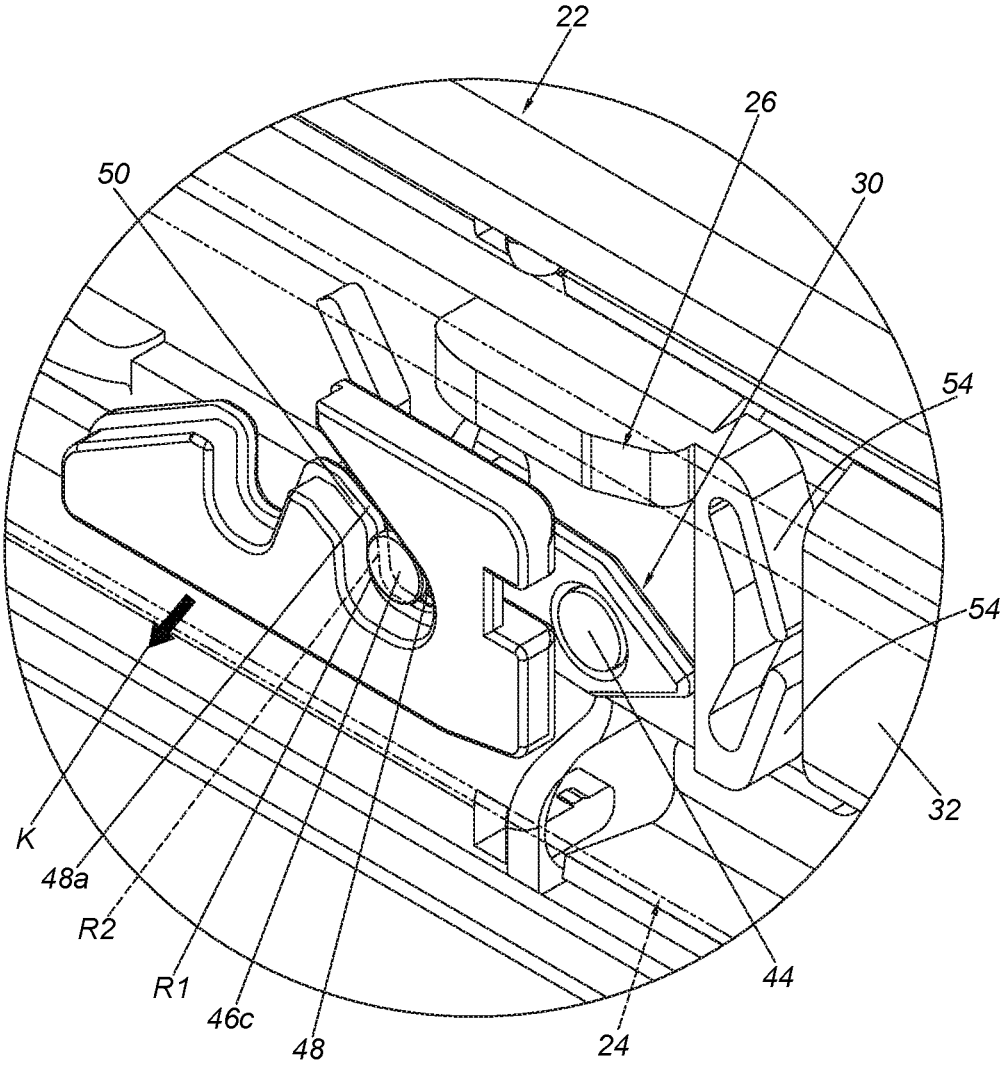
FIG. 14 is an enlarged view of an area A of FIG. 13.

Specifically, a radial dimension of the holding feature 46*c* is greater than a radial dimension of the first part 46*a*. The second rail 24 may be slightly moved relative to the first rail 22 along the predetermined direction K due to mounting tolerance or an unexpected external force, such that a width between the second rail 24 and the first rail 22 is changed from a first width W1 (as shown in FIG. 11) to a second width W2 (as shown in FIG. 13) which is wider than the first width K1. Therefore, when the engaging feature 48 of the second rail 24 is engaged with the first part 46*a* of the actuating structure 46 of the working member 30, the engaging feature 48 of the second rail 24 can be prevented from being detached from the first part 46*a* along the predetermined direction K due to the radial dimension of the holding feature 46*c* being greater than that of the first part 46*a*. Furthermore, at least one first contour R1 of the holding feature 46*c* exceeds at least one second contour R2 of the engaging feature 48 (such as an extension edge 48*a* around the engaging feature 48) of the second rail 24; or, the at least one first contour R1 of the holding feature 46*c* is greater than the at least one second contour R2 of the engaging feature 48 (such as the extension edge 48*a* around the engaging feature 48) of the second rail 24 in order to prevent the engaging feature 48 of the second rail 24 from being detached from the working member 30 along the predetermined direction K. Moreover, when the third rail 32 is in a retracted state relative to the first rail 22, a rear portion of the third rail 32 is configured to abut against a flexible feature 54 of the base 26 (such as an elastic arm shown in FIG. 12 or FIG. 14) to provide a buffering effect.

Figure 15:
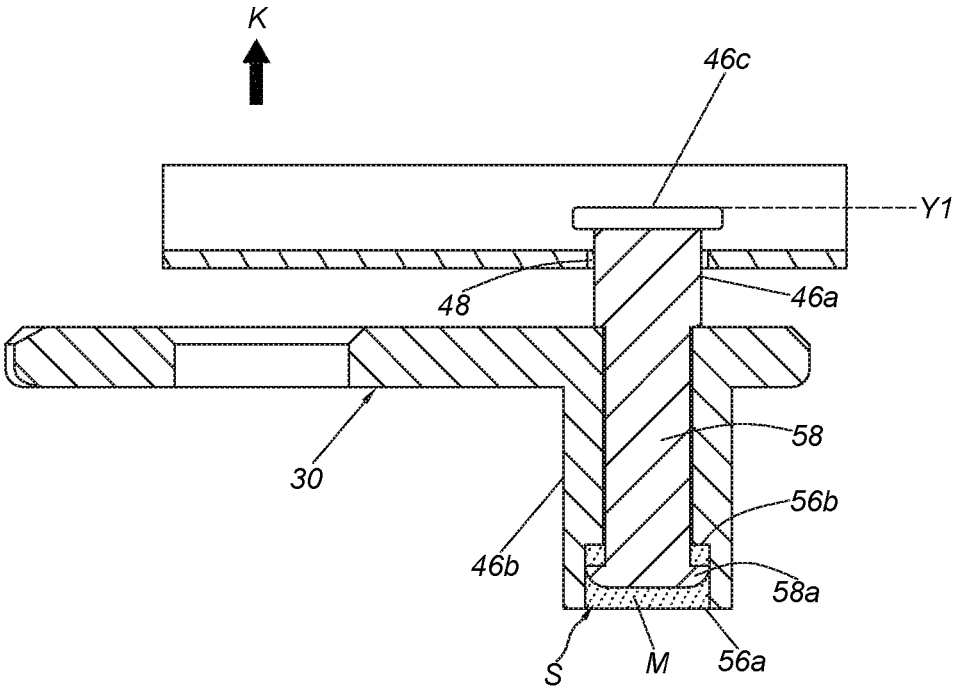
FIG. 15 is a diagram showing a first part of an actuating structure of the slide rail assembly being movable relative to a working member according to an embodiment of the present invention.
Figure 16:
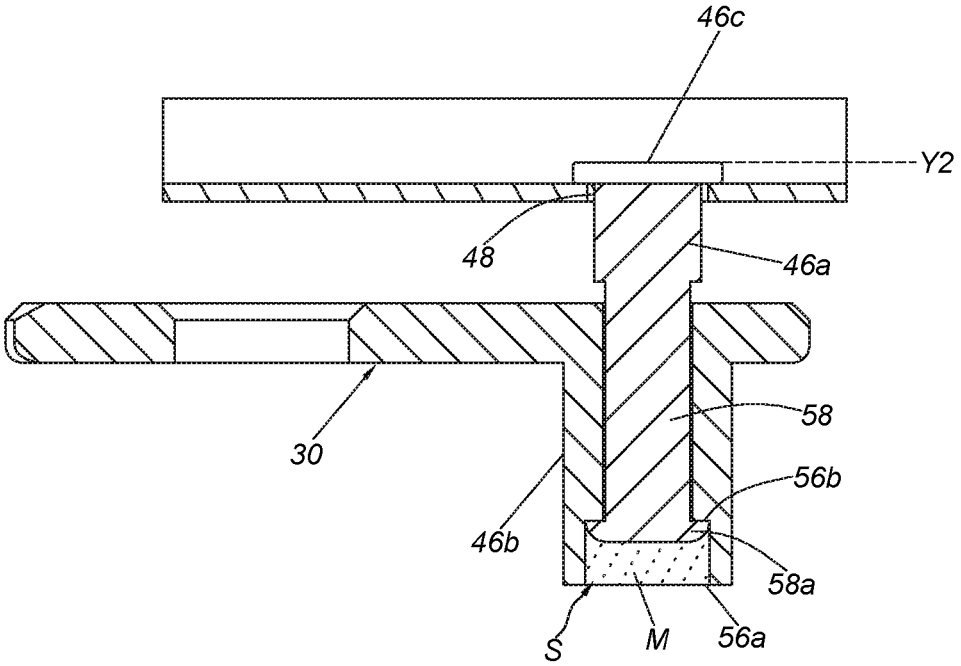
FIG. 16 is a diagram showing a holding feature of the actuating structure of the slide rail assembly of FIG. 15 being configured to prevent the second rail from being detached from the working member along a predetermined direction.

As shown in FIG. 15 and FIG. 16, the working member 30 is formed with a space S and comprises two limiting features (such as a first blocking part 56*a* and a second blocking part 56*b*) defining the space S. The first part 46*a* of the actuating structure 46 is configured to be inserted into the space S through an extension section 58 and a blocking wall 58*a*. Preferably, the holding feature 46*c*, the first part 46*a*, the extension section 58 and the blocking wall 58*a* are integrally formed together. Wherein, the first part 46*a* is located between the holding feature 46*c* and the extension section 58. Preferably, the blocking wall 58*a* is adjacent to an end part of the extension section 58, and the blocking wall 58*a* is located between the two limiting features, such that the first part 46*a* is movable relative to the working member 30 within a limited range.

According to the aforementioned configuration, when the engaging feature 48 of the second rail 24 is engaged with the first part 46*a* of the actuating structure 46 of the working member 30, and the second rail 24 is moved relative to the first rail 22 along the predetermined direction K (such as a transverse direction or a lateral direction), the first part 46*a* of the actuating structure 46 can be driven to move from a first predetermined position Y1 to a second predetermined position Y2. Wherein, the radial dimension of the holding feature 46*c* is greater than the radial dimension of the first part 46*a*, such that the holding feature 46*c* can prevent the engaging feature 48 from being detached from the first part 46*a* or the working member 30 along the predetermined direction K. Preferably, a damping medium M, such as high-viscosity oil (shown as a plurality of black dots in FIG. 15 and FIG. 16), is filled in the space S, such that the first part 46*a* of the actuating structure 46 can be moved slowly relative to the working member 30 to provide a damping or silencing effect.

Figure 17:
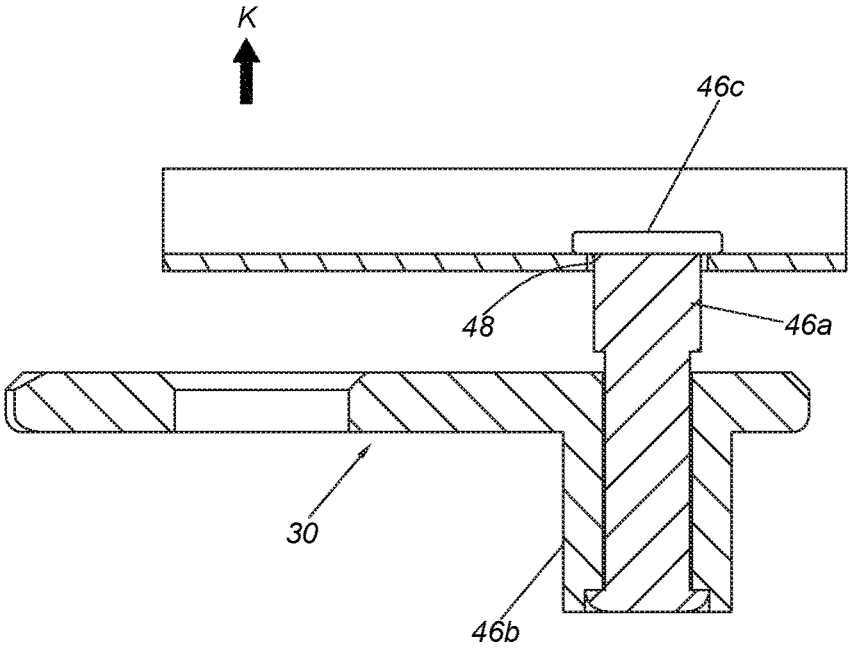
FIG. 17 is a diagram showing a first part of an actuating structure of the slide rail assembly being fixed relative to the working member according to another embodiment of the present invention.

As shown in FIG. 17, different from the aforementioned embodiment with the first part 46*a* of the actuating structure 46 being movable relative to the working member 30, the present embodiment is characterized in that the first part 46*a* of the actuating structure 46 is fixedly connected to the working member 30, and the holding feature 46*c* of the actuating structure 46 can still prevent the engaging feature 48 of the second rail 24 from being detached from the working member 30 along the predetermined direction K. For example, the first part 46*a* of the actuating structure 46 can be fixedly connected to the working member 30 by screwing, riveting or engaging, but the present invention is not limited thereto.

Therefore, the slide rail assembly of the present invention is characterized in that:

1. When the engaging feature 48 of the second rail 24 is engaged with the first part 46*a* of the actuating structure 46, the holding feature 46*c* of the actuating structure 46 can prevent the engaging feature 48 of the second rail 24 from being detached from the first part 46*a* or the working member 30 along the predetermined direction K, so as to improve reliability.

2. The second part 46*b* of the actuating structure 46 is configured to be engaged with the positioning part 34 of the first rail 22 through movement (such as rotation) of the working member 30 relative to the base 26, so as to improve smoothness and stability of the working member 30 being engaged with the positioning part 34.

3. The fixing member 38 and the positioning part 34 (or the positioning member 33) are two separated components. Therefore, a position of the positioning part 34 (or the positioning member 33) relative to the fixing member 38 can be changed according to requirements, so as to meet different market requirements on returning distance of one slide rail (such as the second rail 24) relative to another slide rail (such as the first tail 22).

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly, comprising:

a first rail arranged with a positioning part and a guiding part;

a second rail longitudinally movable relative to the first rail, the second rail being arranged with an engaging feature;

a base configured to be located between a first position and a second position relative to the first rail;

an elastic member configured to provide an elastic force to the base; and a working member rotatable relative to the base, the working member being arranged with an actuating structure, the actuating structure comprising a first part and a second part;

wherein when the second rail is moved relative to the first rail from a retracted position along a first direction, the second rail is configured to drive the working member and the base to move away from the first position through the engaging feature being detachably engaged with the first part of the actuating structure; and when the working member is deflected by the second part of the actuating structure through guiding of the guiding part, the second part of the actuating structure is configured to be engaged with the positioning part to hold the base at the second position, and the first part of the actuating structure is configured to be disengaged from the engaging feature of the second rail;

wherein when the base is held at the second position, the elastic member is configured to accumulate an elastic force along a direction toward the first position in order to retract the second rail from a predetermined position to the retracted position along a second direction;

wherein the first part of the actuating structure is arranged with a holding feature configured to prevent the engaging feature of the second rail from being detached from the working member along a transverse direction when the first part of the actuating structure is detachably engaged with the engaging feature of the second rail;

wherein the working member is formed with a space, and the first part of the actuating structure is movable relative to the working member through the space, and wherein a damping medium is filled in the space.

2. The slide rail assembly of claim 1, wherein the guiding part is adjacent to the positioning part, and the guiding part has one of an inclined surface and a curved surface.

3. The slide rail assembly of claim 1, further comprising a fixing member arranged on the first rail, wherein the base is movably mounted to the first rail, and the elastic member is connected to the fixing member and the base.

4. The slide rail assembly of claim 3, wherein the first rail has a front part and a rear part, and the fixing member is located between the front part and the rear part.

5. The slide rail assembly of claim 4, wherein the fixing member is adjacent to the rear part of the first rail.

6. The slide rail assembly of claim 3, wherein a predetermined distance is defined between the fixing member and the positioning part.

7. The slide rail assembly of claim 1, wherein the working member is pivoted to the base through a shaft, and the first part and the second part of the actuating structure are respectively located at two sides of the working member.

8. The slide rail assembly of claim 1, wherein a radial dimension of the holding feature is greater than a radial dimension of the first part.

9. The slide rail assembly of claim 1, wherein the first part of the actuating structure is fixed relative to the working member.

10. A slide rail assembly, comprising:

a first rail arranged with a positioning part;

a second rail configured to be located between a retracted position and a predetermined position relative to the first rail, the second rail being arranged with an engaging feature;

a base configured to be located between a first position and a second position relative to the first rail;

an elastic member; and a working member pivoted to the base, the working member being arranged with an actuating structure;

wherein when the base is located at the second position with the working member being engaged with the positioning part, the elastic member is configured to accumulate an elastic force along a direction toward the first position;

wherein the second rail is configured to be detachably engaged with the actuating structure on the working member through the engaging feature, in order to disengage the working member from the positioning part, such that the base is moved toward the first position in response to the elastic force of the elastic member, so as to retract the second rail from the predetermined position to the retracted position;

wherein the actuating structure comprises a holding feature configured to prevent the engaging feature of the second rail from being detached from the working member along a predetermined direction when the actuating structure on the working member is detachably engaged with the engaging feature of the second rail; and wherein the predetermined direction is different from a longitudinal direction of the second rail;

wherein the working member is formed with a space, and the holding feature of the actuating structure is movable relative to the working member through the space, and wherein a damping medium is filled in the space.

11. The slide rail assembly of claim 10, further comprising a fixing member arranged on the first rail, wherein the base is movably mounted to the first rail, and the elastic member is connected between the fixing member and the base.

12. The slide rail assembly of claim 11, wherein the first rail has a front part and a rear part, and the fixing member is located adjacent to the rear part of the first rail.

13. The slide rail assembly of claim 11, wherein a predetermined distance is defined between the fixing member and the positioning part.

14. The slide rail assembly of claim 10, wherein when the engaging feature of the second rail is engaged with the actuating structure of the working member, at least one first contour of the holding feature exceeds at least one second contour of the engaging feature of the second rail in order to prevent the engaging feature of the second rail from being detached from the working member along the predetermined direction.

15. A slide rail assembly, comprising:

a first rail arranged with a positioning part;

a second rail movable relative to the first rail from a retracted position along a first direction, the second rail being arranged with an engaging feature;

a base movably mounted to the first rail;

an elastic member configured to provide an elastic force to the base; and a working member rotatable relative to the base, the working member being arranged with an actuating structure, the actuating structure comprising a first part and a second part;

wherein the second part of the actuating structure is configured to be engaged with the positioning part of the first rail, in order to allow the elastic member to accumulate the elastic force for moving the second rail from a predetermined position to the retracted position along a second direction;

wherein the first part of the actuating structure is configured to be detachably engaged with the engaging feature of the second rail, the first part of the actuating structure is arranged with a holding feature configured to prevent the engaging feature of the second rail from being detached from the working member along a predetermined direction when the first part of the actuating structure is detachably engaged with the engaging feature of the second rail; and wherein the predetermined direction is different from the first direction and the second direction;

wherein the working member is formed with a space, and the first part of the actuating structure is movable relative to the working member through the space, and wherein a damping medium is filled in the space.

16. The slide rail assembly of claim 15, wherein the first rail is further arranged with a guiding part adjacent to the positioning part, and the guiding part has one of an inclined surface and a curved surface for guiding the second part of the actuating structure to be engaged with the positioning part of the first rail.

17. The slide rail assembly of claim 15, further comprising a fixing member arranged on the first rail, wherein the elastic member is connected to the fixing member and the base.

18. The slide rail assembly of claim 15, wherein the working member comprises two limiting features defining the space, the first part of the actuating structure is movable relative to the working member within a limited range through the space, a radial dimension of the holding feature is greater than a radial dimension of the first part, the holding feature is configured to prevent the engaging feature of the second rail from being transversely detached from the working member.

* * * * *